US005864970A

United States Patent [19]

Maddock et al.

[11] Patent Number: 5,864,970

[45] Date of Patent: Feb. 2, 1999

[54] EARTH EXCAVATING APPARATUS

[76] Inventors: David C. Maddock, 8309 Anne Ave., Bloomington, Ind. 47401; William E. Maddock, Box 229-A, Bicknell, Ind. 47512

[21] Appl. No.: 589,821

[22] Filed: Jan. 22, 1996

[51] Int. Cl.[6] ..... E02F 5/08

[52] U.S. Cl. ..... 37/94; 37/91; 37/908; 404/91

[58] Field of Search ..... 37/91, 92, 93, 37/94, 248, 260, 261, 262, 361, 908; 299/39.1, 39.2, 39.4, 39.6; 404/91, 90, 127; 172/815

[56] References Cited

U.S. PATENT DOCUMENTS

| | | | |
|---|---|---|---|
| 2,736,111 | 2/1956 | Moen | 37/248 |
| 2,798,314 | 7/1957 | Brite | 37/94 |
| 2,801,479 | 8/1957 | Brauer | 37/189 |
| 2,974,735 | 3/1961 | Smith et al. . | |
| 3,194,320 | 7/1965 | Kirkpatrick . | |
| 3,417,495 | 12/1968 | Barras | 37/189 |
| 3,445,944 | 5/1969 | Speno . | |
| 3,452,461 | 7/1969 | Hanson | 37/189 |
| 3,683,522 | 8/1972 | Rousseau et al. | 37/91 |
| 3,706,145 | 12/1972 | Bucksch et al. | 37/105 |
| 3,841,006 | 10/1974 | Mironov et al. | 37/189 X |
| 3,916,543 | 11/1975 | Poche . | |
| 4,193,217 | 3/1980 | Poche . | |
| 4,197,036 | 4/1980 | Masquelier | 405/303 |
| 4,619,061 | 10/1986 | Swanson | 37/248 |
| 4,682,427 | 7/1987 | Dondi | 37/91 |
| 4,701,069 | 10/1987 | Whitney . | |
| 4,786,111 | 11/1988 | Yargici | 299/39.4 X |
| 4,852,656 | 8/1989 | Banahan . | |
| 4,942,682 | 7/1990 | McDowell | 37/94 X |
| 4,969,279 | 11/1990 | Mantingh | 37/91 X |
| 5,046,890 | 9/1991 | Dickson | 299/39.9 X |
| 5,092,658 | 3/1992 | Smith | 299/39.4 |
| 5,101,583 | 4/1992 | Scordilis | 37/91 |
| 5,108,221 | 4/1992 | Skibsted . | |
| 5,197,820 | 3/1993 | Skibsted . | |
| 5,199,195 | 4/1993 | Scordilis et al. . | |
| 5,214,867 | 6/1993 | Weatherly et al. . | |
| 5,304,013 | 4/1994 | Parsons . | |

FOREIGN PATENT DOCUMENTS

| | | | |
|---|---|---|---|
| 1193456 | 11/1959 | France | 37/92 |
| 1092391 | 11/1960 | Germany | 37/92 |

*Primary Examiner*—Terry Lee Melius
*Assistant Examiner*—Thomas A. Beach
*Attorney, Agent, or Firm*—Woodard, Emhardt, Naughton Moriarty & McNett

[57] ABSTRACT

An earth excavating apparatus is disclosed as operable to loosen earthen material and expel the loosened earthen material away from the apparatus. One embodiment of the apparatus includes a rotatable drum partially disposed within a housing and having a plurality teeth thereon adapted to loosen earth and direct the loosened earth into the housing as the drum rotates. A discharge fan is further disposed within the housing and is operable to expel the loosened earthen material from within the housing away from the apparatus. The apparatus may be towed by a vehicle and the rotatable drum is adjustable between a vertical transport position and an excavating position of approximately 45 degrees below horizontal. An alternate embodiment of the apparatus includes the drum/fan arrangement of the first embodiment adjustably mounted to a boom arrangement. The drum/fan arrangement may be adjustably positioned on the boom between a transport position and a variety of excavating positions.

19 Claims, 6 Drawing Sheets

EARTH EXCAVATING APPARATUS

FIELD OF THE INVENTION

The present invention relates generally to devices for maintaining road shoulders and ditch profiles, and more specifically to such devices utilizing an earth excavating apparatus to loosen and relocate earthen material.

BACKGROUND OF THE INVENTION

In the construction and maintenance of roads, drainage ditches are commonly constructed alongside the roadway to provide for the drainage of fluid from the road surface therein. Since roads are typically "crowned", or sloped from the center of the road downwardly toward each road edge, two such drainage ditches are typically provided with one on each side of the road.

A known problem associated with such an arrangement, particularly true with respect to gravel roads, is the formation of raised road shoulders, or so-called berms, between the roadway and the respective ditches. Such berms form due to vehicular travel on the road which acts to wear down the road surface and/or relocate a portion of the road surface on the shoulder thereof. Another source of berm formation is vegetation growth along a road shoulder which, if left unattended, tends to trap loose soil therein from road graters, snow removal equipment and other vehicles.

A known problem associated with drainage ditches, again particularly true with respect to gravel roads, is the accumulation of earthen material therein. Such accumulation may be due to a number of causes, such as soil and sediment carried therein via fluid drainage from the road, formation of vegetation therein and loose soil deposited therein from road graters and snow removal equipment.

An end result common to the foregoing problems is the accumulation of fluid on the road surface, due to improper drainage therefrom, which accumulation rapidly deteriorates the road surface by forming bumps and fluid retaining reservoirs therein. Such deterioration then produces the need for road grating which may further aggravate the problem.

Several road treatment apparatuses have been designed with an intent to alleviate at least some of the foregoing problems. An example of one known berm reducing apparatus is provided in U.S. Pat. No. 5,199,195 to Scordilis et al. which discloses a berm reducing apparatus having an earth cutting drum mounted transversely to a vehicle, wherein the drum may include a number of earth cutting teeth thereon. The drum is disclosed as being actuatable between a vertical transport position and a cutting angle of approximately 30 degrees below horizontal. The Scordilis et al. berm reducing apparatus is thus operable to cut, and thereby loosen, both berms and ditch sidewalls. However, the apparatus is operable only to windrow the excavated earth to one or the other side of the cutting drum so that the windrowed earthen material must be subsequently collected by another apparatus in order to finish the job. While the earth cutting and windrowing operation may be easily accomplished with the Scordilis et al. apparatus, the task of collecting the windrowed earth is arduous and time consuming.

What is therefore needed is a berm reducing apparatus operable to excavate both berms and ditch sidewalls, and to further expel the excavated material over the ditch so as not to cause undue accumulation of earthen material in the ditch. However, since many roads in need of such treatment line residential and commercial property, such an apparatus should further include an option to windrow the excavated earthen material for subsequent collection. Finally, such an apparatus would preferably permit the vehicle operator to excavate berms and/or ditches having obstructions therein, without requiring the vehicle operator to interrupt the forward motion of the vehicle.

SUMMARY OF THE INVENTION

The foregoing problems and shortcomings of prior art apparatuses are overcome by the present invention. In accordance with one aspect of the present invention, an earth excavating apparatus includes a housing, a rotatable drum partially disposed within the housing and adapted to loosen earthen material from the earth and direct the loosened earthen material into the housing as said drum rotates, means for rotating the drum, and a discharge fan disposed within the housing away from the earth and adapted to expel the loosened earthen material within the housing away from the apparatus.

In accordance with another aspect of the present invention an earth excavating apparatus towed by a vehicle includes a frame, a housing, a rotatable drum partially disposed within the housing and supported by the frame, wherein the rotatable drum extends generally transversely away from the vehicle in contact with the earth adjacent the vehicle, and the rotatable drum is adapted to loosen earthen material from the earth and direct the loosened earthen material into the housing as said drum rotates. A discharge fan is mounted within the housing away from the earth, wherein the discharge fan collects a portion of the loosened earthen material from within the housing and expels the collected earthen material away from the apparatus.

In accordance with yet another aspect of the present invention, an earth excavating apparatus includes a frame, an elongated boom supported by the frame and a rotatable drum adjustably mounted to the boom such that the drum is longitudinally extendable toward and away from the frame during operation of the apparatus. The rotatable drum is in contact with the earth and adapted to loosen earthen material from the earth as the drum rotates. Means for directing the loosened earthen material away from the apparatus are further included.

One object of the present invention is to provide an earth excavating apparatus operable to loosen earthen material and expel the loosened earthen material away from the apparatus.

Another object of the present invention is to provide such an earth excavating apparatus alternately operable to windrow the loosened earthen material.

Yet another object of the present invention is to provide such an apparatus which may be carried by a vehicle.

Still another object of the present invention is to provide an earth excavating apparatus having an earth excavating drum adjustably mounted to a boom such that the drum may be adjustably positioned in a direction transverse to the direction of travel to thereby vary the width of the excavation path.

These and other objects of the present invention will become more apparent from the following description of the preferred embodiment.

DESCRIPTION OF THE PREFERRED EMBODIMENT

Figure 1:
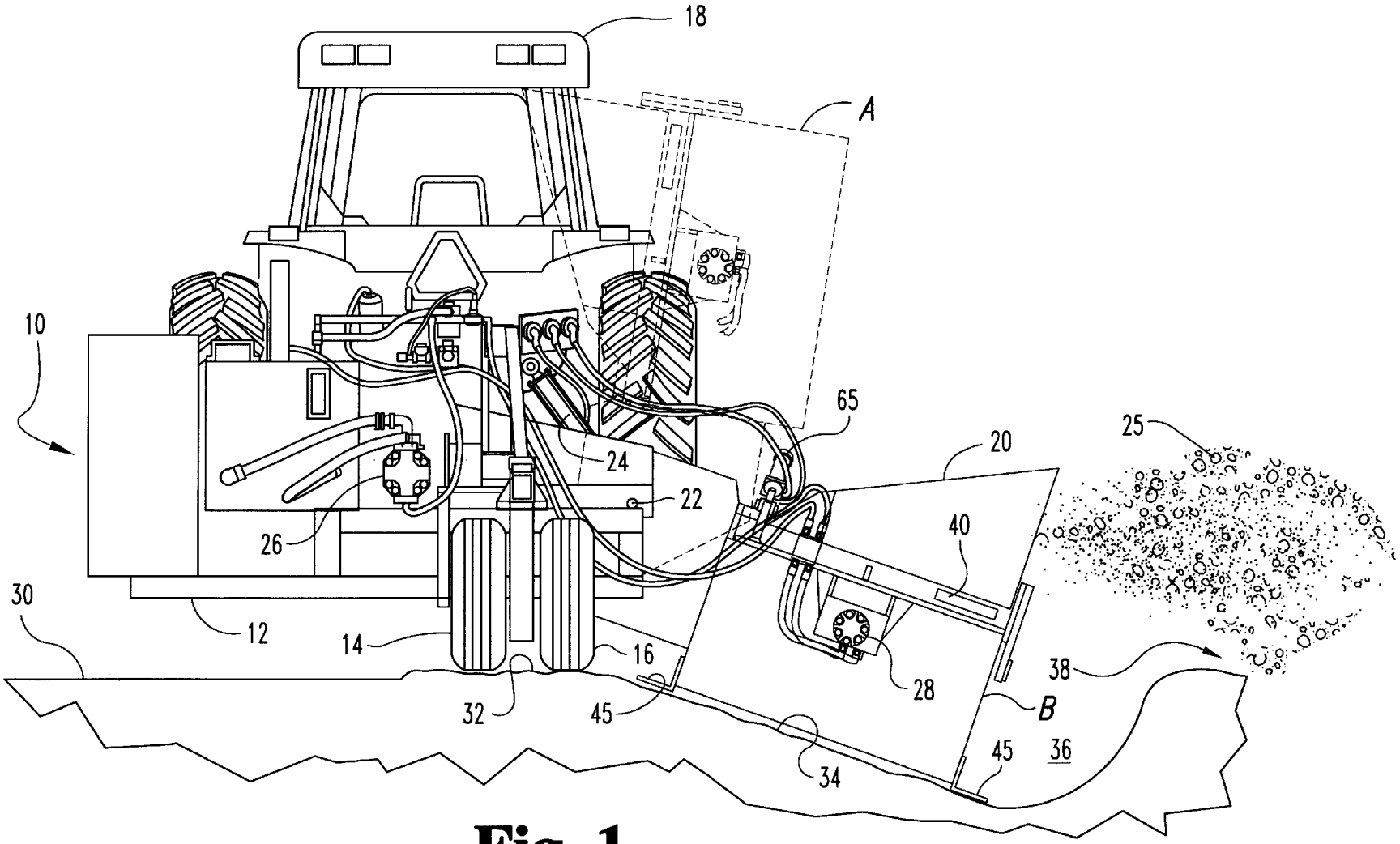
FIG. 1 is a rear plan view of an earth excavation apparatus towed by a vehicle in accordance with one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

Referring now to FIG. 1, an earth excavation apparatus 10, in accordance with one embodiment of the present invention, is shown. Apparatus 10 includes a frame 12 supported by wheels 14 and 16 and operatively connected to a towing vehicle 18 such as, for example, a tractor. It is to be understood, however, that towing vehicle 18 may be any vehicle having towing capability.

Central to the earth excavating apparatus 10 is earth excavating assembly 20. Assembly 20 is pivotably connected to frame 12 at pivot location 22 such that pivot actuator 24 is operable to pivot assembly 20 between a vertical transporting position, shown as position A, and approximately 45 degrees below horizontal, shown as position B. Pivot actuator 24 may be any known device for controlling the corresponding pivoting action, although actuator 24 is preferably a pneumatically or hydraulically controlled actuator.

As will be discussed more fully with respect to FIGS. 2–4, assembly 20 includes an earth excavating drum 52 and an earth discharge fan 55 therein. Drum 52 and fan 55 are preferably driven via hydraulic motors 26 and 28 respectively, although the present invention contemplates that other known driving motors may be used. Motors 26 and 28 are preferably powered by a power take off (PTO) of the towing vehicle 18 as is known in the art, although the present invention contemplates that motors 26 and 28 may alternatively be powered by one or more engines located on board earth excavating apparatus 10.

Although earth excavating apparatus 10 may be used to excavate earth in a variety of desired applications, at least two such applications should be highlighted in view of the foregoing discussion of the prior art in the BACKGROUND section. One such application is shown in FIG. 1 wherein towing vehicle 18 is operable to tow earth excavating apparatus 10 along a shoulder 32 of a road 30 such that earth excavating assembly 20 extends into a ditch 36. Owing to the ability of assembly 20 to operatively extend downwardly to approximately 45 degrees below horizontal, the ditch sidewall 34 may easily be reshaped by apparatus 10. Thus, ditches 36 that are improperly shaped due to poor initial formation thereof or accumulation of earthen material therein, may be reformed, or restored, to a desirable profile. Apparatus 10 is further advantageous in that it is not only operable to shape ditch sidewall 34, but due to the operation of discharge fan 55, as will be more fully discussed hereinafter, most of the earthen material 25 excavated by apparatus 10 is forcefully propelled from assembly 20, via discharge opening 60 (FIG. 2), to the opposite side 38 of ditch 36 as shown in FIG. 1. The use of earth excavation apparatus 10 thus obviates the need for subsequent collection of excavated earthen material, while also avoiding any relocation of the excavated earthen material within ditch 36.

A second notable application of earth excavating apparatus 10 is for the removal, or reduction, of excess earthen material (so-called berms) on the shoulder 32 of road 30. An example of this application is illustrated in FIG. 2. In this particular application, earth excavating assembly 20 is preferably positioned approximately 3 degrees below horizontal, which position permits apparatus 20 to excavate shoulder 32 in such a manner as to provide for adequate draining of fluid from the surface of road 30 into ditch 36, while maintaining a sufficient shoulder area 32. As with the previous application, the use of apparatus 10 is advantageous over known methods of berm removal in that discharge fan 55 is operable to forcefully propel most of the excavated earthen material 25 from assembly 20, via discharge opening 60, to the opposite side 38 of ditch 36. Apparatus 10 thus provides for easy berm removal without the need for subsequent collection of the excavated earthen material, while also avoiding any relocation of the excavated berm within ditch 36.

Figure 2:
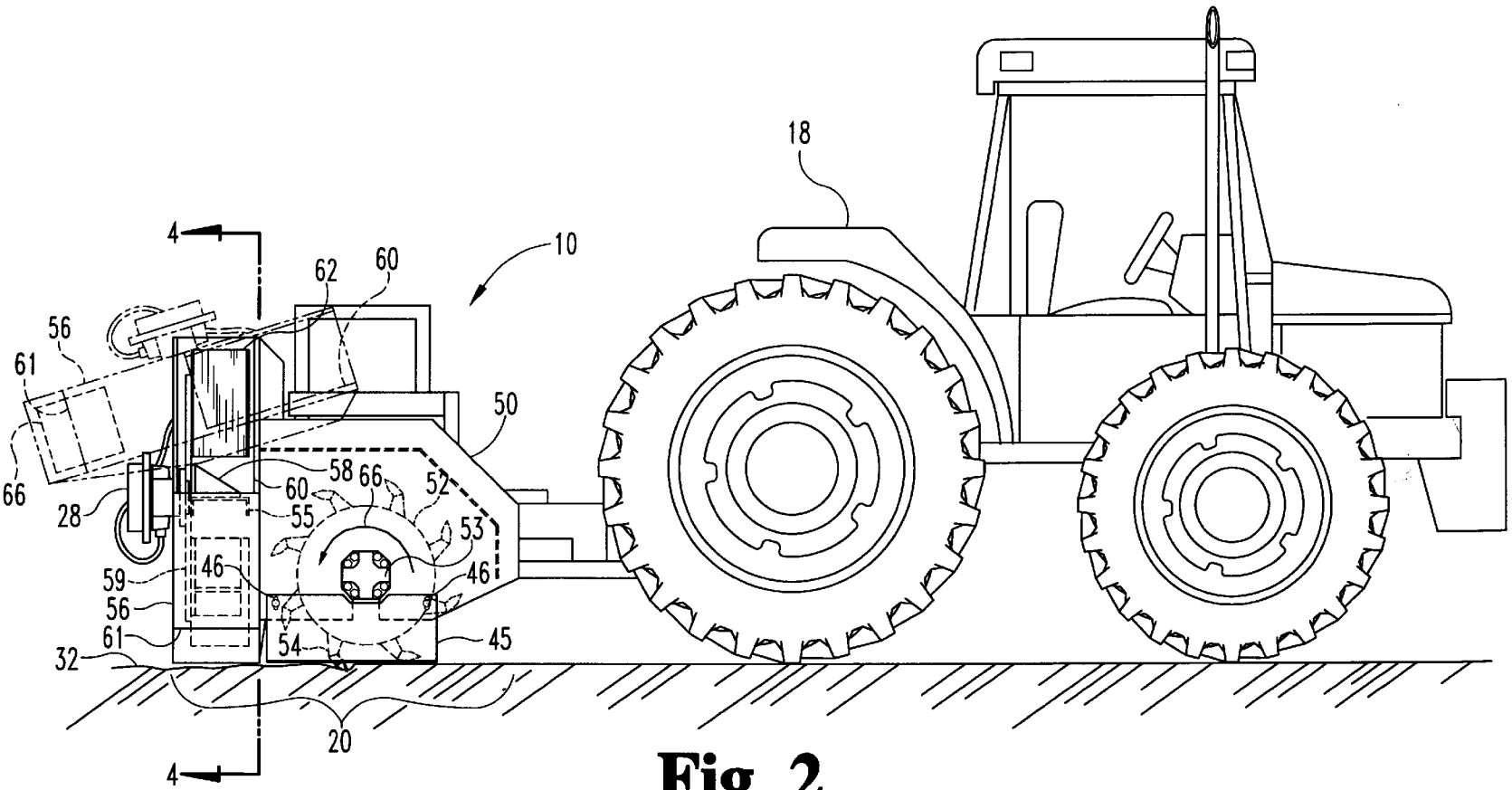
FIG. 2 is a side view of the earth excavation apparatus of FIG. 1.
Figure 3B:
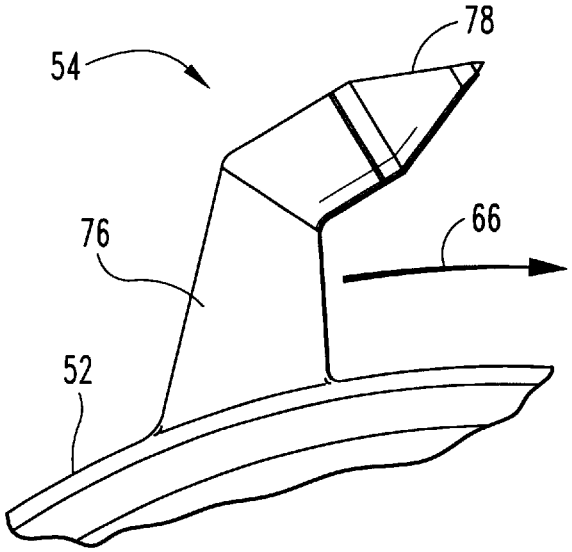
FIG. 3 is a rear plan view of an earth excavating drum for use in an earth excavating apparatus of FIG. 1.
Figure 3A:
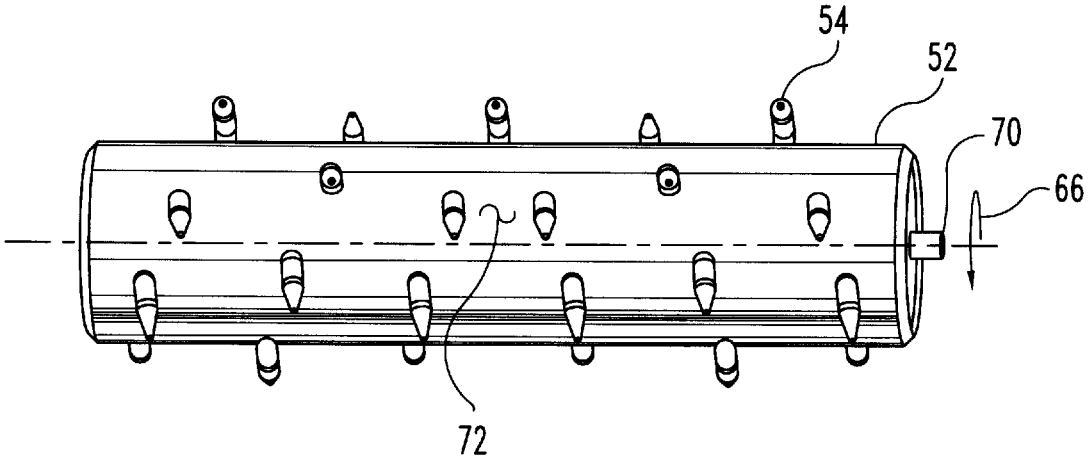
Figure 4:
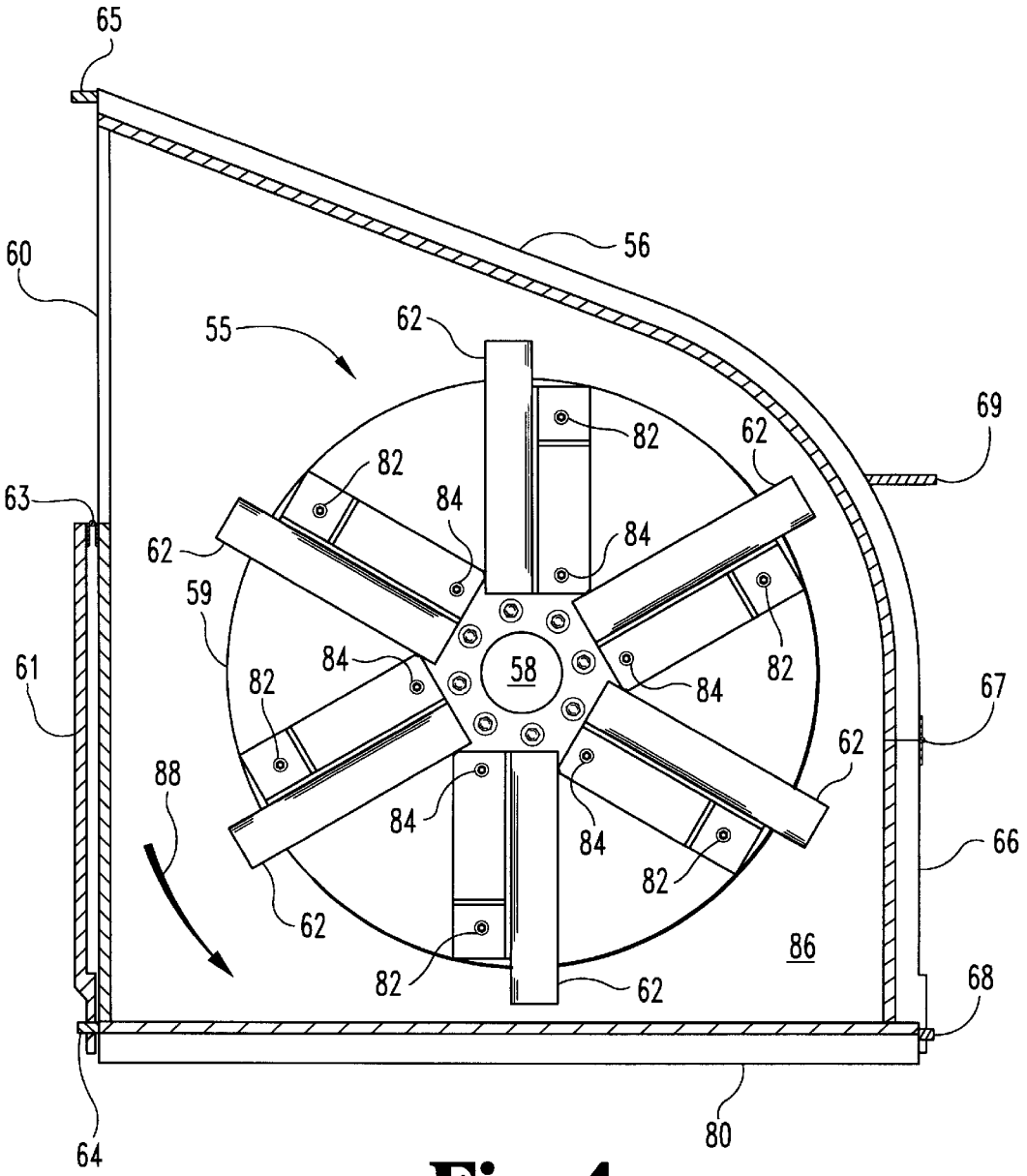
FIG. 4 is a cross-sectional view, taken along section lines 4—4 of FIG. 2, of the discharge fan and surrounding housing of the earth excavating apparatus of FIG. 1.

Referring now to FIGS. 2–4, one preferred structure of earth excavating assembly 20, and operation thereof, will be described in detail. Assembly 20 includes a housing 50 which partially surrounds an earth excavating drum 52. Preferably, housing 50 is configured such that it contains a substantial portion of drum 52 therein. A pair of skis 45 (see also FIG. 1) are attached to either side of housing 50 via a number of fasteners. Each of the fasteners are received within a corresponding slot 46 so that skis 45 may be adjustably positionable with respect to housing 50 to thereby act as a depth control mechanism operable to control the excavating depth of drum 52. Drum 52 is attached to housing 50 on each side thereof via a hub/bearing combination 53. Earth excavating drum 52 is operable to rotate in a direction opposing the direction of the towing vehicle 18, which rotational direction is also known as an up-cut direction. Since the wheels of towing vehicle rotate clockwise (FIG. 2) in order to move in a forward direction, excavating drum 52 is thus driven by motor 26 in a counter clockwise direction 66. An up-cut excavating direction of drum 52 is desirable for at least two reasons. First, it provides for maximumly efficient excavating operation. Secondly, and more importantly, it protects against a condition known as over-run wherein drum 52, if rotating in a clockwise direction, could act as an extra drive wheel of the apparatus 10/vehicle 18 combination and thus attempt to drive towing vehicle 18.

Referring now to FIG. 3A, earth excavating drum 52 includes an axle 70 attachable to hub 53 on each side of drum 52, and a plurality of earth excavating teeth 54 thereon. Preferably, teeth 54 are arranged in a dual helical pattern toward the center 72 of drum 52. As such, drum 52 is operable to direct excavated earthen material toward its center 72 as it rotates in the direction of arrow 66. Although the foregoing dual helical arrangement of teeth 54 on drum 52 is preferable, as will be explained in greater detail hereinafter, the present invention contemplates other arrangements of teeth 54.

Referring now to FIG. 3B, each tooth 54 includes a tool holding portion 76 having an earth excavating tool 78 mounted thereto, wherein tool 78 is preferably a pointed carbide-tipped earth cutting tool. Tool holding portion 76 is preferably configured to resist shearing from drum 52 due to rocks, tree roots and other foreign objects encountered thereby.

Referring back to FIG. 2 and to FIG. 4, assembly 20 further includes a discharge fan 55 disposed within a discharge fan housing 56. Discharge fan 55 includes a central hub 58 attached to a disc 59, preferably formed of steel. Mounted to disc 59 are a number of fan blades 62. Preferably, fan blades 62 are each mounted to disc 59 with two fasteners 82 and 84, one of which serves as a shear fastener operable to break away when obstructions are encountered.

Fan housing 56 includes a first closable door 61 pivotably mounted thereto such that door 61 defines a portion of housing 56 when closed, and defines a first discharge opening 60 therethrough when closed. Preferably, door 61 is connected to housing 56 via hinge 63, although any known pivotable connection may be made therebetween. Means are further provided to maintain door 61 in either operable position. Preferably such means are associated with housing 56 and may comprise a peg or pin 65 attached to housing 56 to provide for the locking of door 61 in a closed position, and a peg or pin 64 attached to housing 56 to provide for the locking of door 61 in an open position. It is to be understood, however, that any known means may be used to maintain door 61 in either of the open and closed positions.

Fan housing 56 further includes a second closable door 66 pivotably mounted thereto such that door 66 defines a portion of housing 56 when closed, and defines a second discharge opening therethrough when opened. As with door 61, door 66 is preferably connected to housing 56 via hinge 67, although any known pivotable connection may be made therebetween. Means are further provided to maintain door 66 in either operable position. Preferably such means are associated with housing 56 an may comprise a peg or pin 68 attached to housing 56 to provide for the locking of door 66 in a closed position, and a peg or pin 69 attached to housing 56 to provide for the locking of door 61 in an open position. Peg or pin 69 may be positioned at a variety of locations on housing 56 to thereby maintain door 66 in a corresponding variety of open positions. Those skilled in the art will recognize that any known means may be used to maintain doors 61 and 66 in either of the open and closed positions, and that the door locking feature discussed hereinabove is not limited to the peg/pin arrangement.

Fan housing 56 further includes a bottom portion 80 such that fan 55 is completely surrounded by housing 56 with the exception of the first and second discharge openings which may be provided by opening doors 61 and 66 respectively. Fan housing 56 thus defines a housing interior 86 in which fan 55 is positioned. Hub 58 defines an axis of rotation therethrough which is preferably disposed perpendicular to the axle 70 of earth excavating drum 52.

In a preferred mode of operation, fan 55 thus rotates about an axis perpendicular to the axis of rotation of earth excavating drum 52. With skis 45 suitably adjusted to provide a desired excavation depth, as previously described, drum 52 rotates counter clockwise 66 (in opposition to the direction of travel of towing vehicle 18) such that teeth 54 dig into berm 32 (FIG. 2), ditch side wall 34 (FIG. 1) or other earthen mass. Due to the orientation of teeth 54 and the direction 66 of drum 52 rotation, earthen material loosened by drum 52 is directed toward the center 72 (FIG. 3A) of drum 52 and into drum housing 50. Discharge fan 55 is located directly behind drum 52 such that hub 58 is generally centered at the mid-circumferential point 72 thereof, and fan housing 56 abuts drum housing 50. A substantial portion of the loosened earthen material carried by earth excavating drum 52 is thus directed thereby into housing 56, and particularly into the rotational path of fan 55. With door 61 open to thereby define discharge opening 60, and door 66 closed as shown in FIG. 4, fan blades 62 then collect the loosened earthen material provided thereto by rotating drum 52. Fan 55 rotates in a direction 88 to thereby forcefully propel the collected earthen material 25 out of discharge opening 60.

It should be pointed out that due to the configuration of fan housing 56, fan blades 62 never contact the underlying earth surface or any earthen material deposited thereon by drum 52. Rather, fan blades 62 are operable to collect a substantial portion of the loosened earthen material provided thereto by earth excavating drum 52, and any excess earthen material is trapped within the interior 86 of housing 56 by bottom housing portion 80, where it is collected by fan blades 62 and expelled from housing 56 via discharge opening 60.

In addition to the foregoing operation, earth excavating apparatus 10 has two alternative operational modes. Each of the two alternative operational modes are intended for conditions which prohibit expelling of the loosened earthen material from discharge opening 60, such as the existence of developed land (residential, commercial or otherwise) on the opposite side 38 of ditch 36, for example. In such instances, it is preferable to windrow, or otherwise discharge, the loosened earthen material for subsequent collection by a trailing vehicle (not shown).

In accordance with a first alternative operational mode, door 61 is closed and door 66 is opened to thereby provide a discharge opening therethrough. With fan 55 rotating in direction 88, as previously described, the collected earthen material 25 is thus propelled out of the discharge opening defined by open door 66. Although the first alternative operation mode of apparatus 10 may be used in any desired excavation situation, it is primarily intended for use when excavating earthen material adjacent to a paved road. With apparatus 10 properly positioned, the discharge opening define by open door 66 provides a suitable path for deposition of the excavated earthen material onto the paved portion of the road, where subsequent collection by a trailing vehicle is made easier. Although not explicitly shown in the drawings, those skilled in the art will recognize that door 66 may be locked in any of a variety of open positions to thereby provide for selective positioning of the earthen material propelled through the discharge opening defined thereby.

In accordance with a second alternative operational mode of apparatus 10, earth excavating assembly 20 is provided with an actuating piston 65, preferably pneumatically or hydraulically actuated, connected between drum housing 50 and fan housing 56 (see FIGS. 1 and 2). With fan 55 deactivated, fan housing 56 may be raised, via actuating piston 65, away from drum housing 50 as shown in phantom in FIG. 2. With fan housing 56 so positioned, earth excavating apparatus 10 is operable to windrow the excavated earthen material behind drum 52. Since teeth 54 are arranged in a dual helical pattern toward the center 72 of drum 52 as previously described, the excavated earthen material will be windrowed substantially centrally behind drum 52 for subsequent collection by a trailing vehicle. Although the foregoing second alternative operational mode may be used in any desired excavating situation, it is primarily intended for use when excavating shoulders of unpaved roads.

Referring again to FIG. 1 specifically, earth excavating assembly 20 is further provided with a known leveling means 40 operable to maintain earth excavating assembly 20 at a predetermined angle with respect to horizontal regardless of the pitch of frame 12. Since the surface upon which frame 12 is traveling, which may be road 30 or road shoulder 32, may vary due to sloping and/or bumps therein, leveling means 40 may be preset to a level condition at any desired excavating angle of assembly 20 as is known in the art. Thereafter, leveling means 40 automatically maintains assembly 20 at the predetermined angle regardless of changing angle conditions associated with the frame 12.

Figure 5:
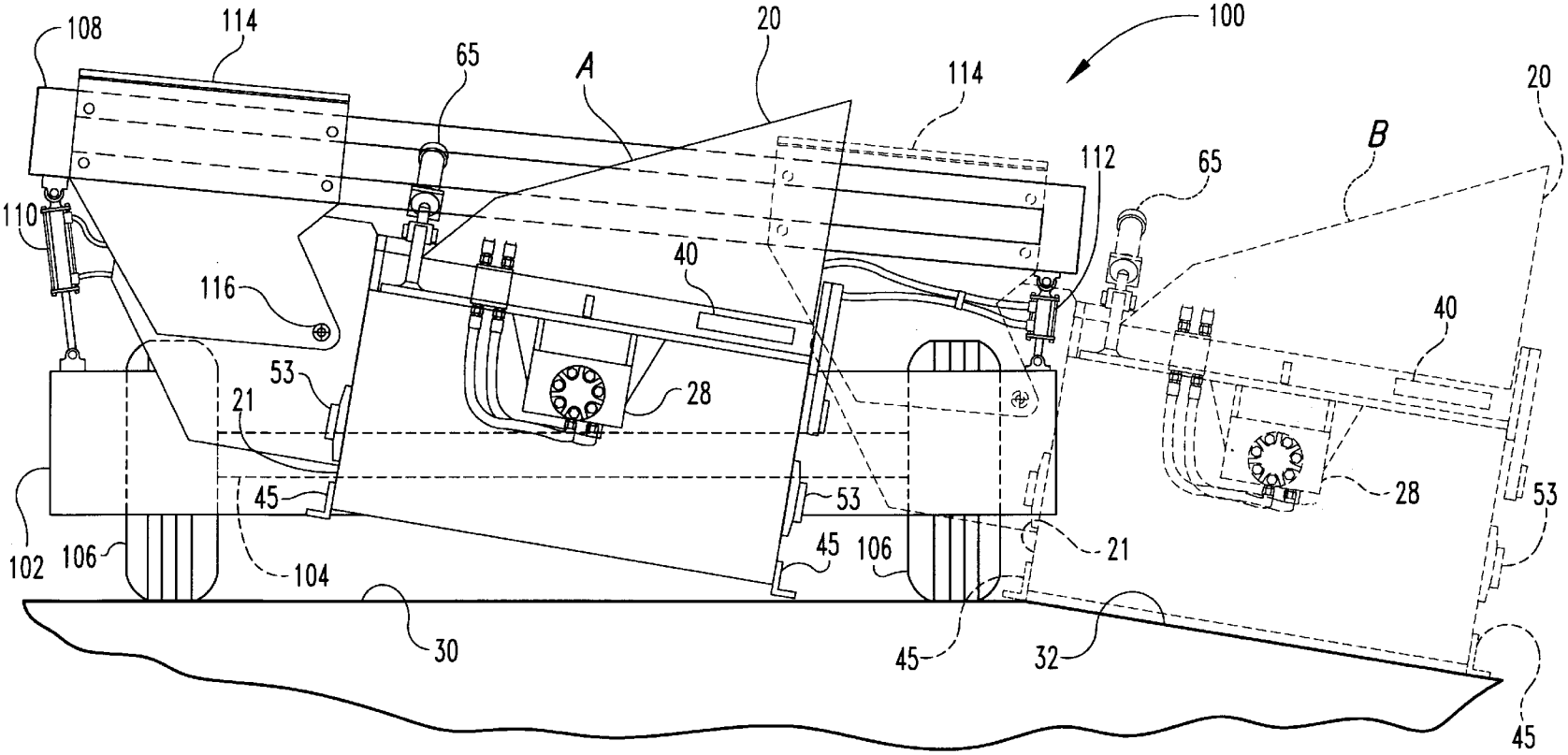
FIG. 5 is a rear plan view of an earth excavating apparatus towed by a vehicle in accordance with an alternate embodiment of the present invention.

Referring now to FIG. 5, an earth excavation apparatus 100, in accordance with another embodiment of the present invention, is shown. In most respects, apparatus 100 is identical in features and operation to apparatus 10 so that illustration and description thereof need not be repeated. Apparatus 100 is, however, advantageously configured to provide an additional degree of freedom of movement, and corresponding control of, earth excavating assembly 20 over the embodiment illustrated in FIGS. 1–4. Specifically, apparatus 100 includes a frame 102 supporting an axle 104 having wheels 106 mounted on either side thereof. In the present embodiment, the axle 104 arrangement is preferably included to support boom 108 attached to frame 102 at either end thereof via actuating pistons 110 and 112 respectively. Alternatively to attaching frame 102 to boom 108 thereabove as shown in FIG. 5, frame 102 may be extended above boom 108 such that boom 108 is attached to frame 102 thereabove by pistons 110 and 112. In either case, pistons 110 and 112 are preferably pneumatically or hydraulically actuated and are operable to raise/lower and otherwise position boom 108 at any desired angle with respect to frame 102. Earth excavating apparatus 20 is attached to boom 108 via collar 114 which may be pneumatically or hydraulically controlled to slide along boom 108 between positions A and B of FIG. 5. Collar 114 is attached to assembly 20 via pivot point 116, and assembly 20 is actuatable to a variety of angle with respect to boom 108 about pivot point 116 in a manner as previously described. Position A is intended as a transport position, and means are included with apparatus 100 (not shown) to disable earth excavating drum 52 in the transport position A as a safety precaution.

In position B, assembly 20 is fully operational, in any of the operational modes previously described with respect embodiment 10, to excavate earth with excavating drum 52. Additionally, during operation thereof, assembly 20 may further be retracted on boom 108. As assembly 20 is retracted onto boom 108, side 21 thereof begins to lift above ground level, thereby effectively decreasing the excavation width of drum 52. In all other respects, apparatus 100 is identical in operation and features to embodiment 10 discussed with respect to FIGS. 1–4.

Figure 6C:
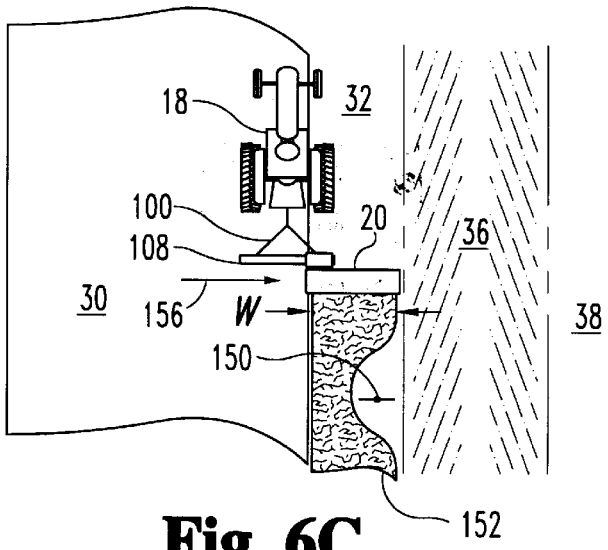
FIG. 6 is composed of FIGS. 6A, 6B and 6C, and illustrates a top plan view of an operable mode of the earth excavating apparatus of FIG. 5 to avoid obstructions by modulating the excavation path width.
Figure 6B:
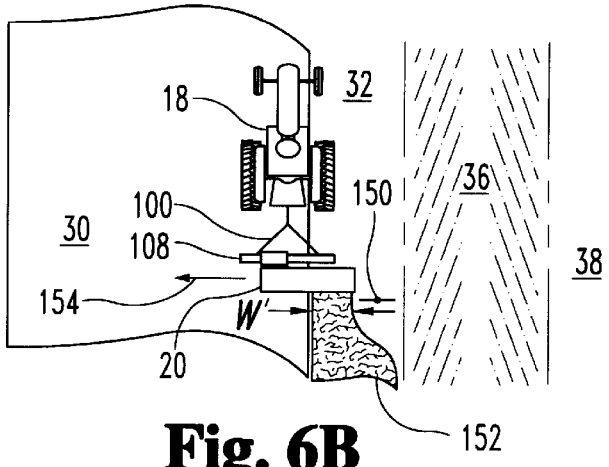
Figure 6A:
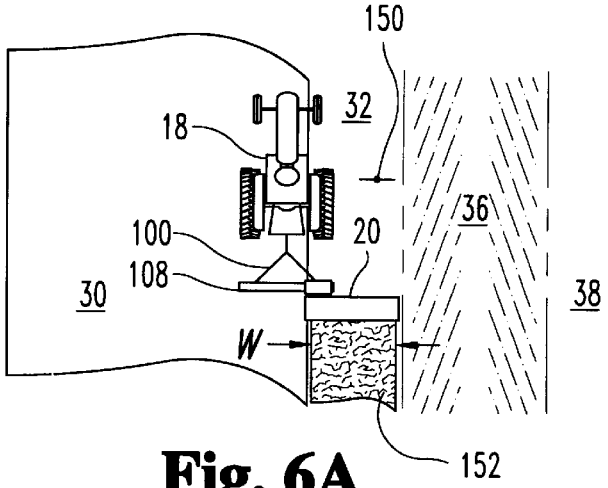

Referring now to FIGS. 6A–6C, an excavating application is illustrated which takes advantage of the foregoing added degree of freedom of assembly 20 of apparatus 100. In FIG. 6A, towing vehicle 18 is shown towing apparatus 100 having assembly 20 fully extended away from boom 108 such that assembly 20 is operable to excavate a path 152 of full width W. Preferably, W is approximately 48 inches, which is set by the physical width of drum 52, although the present invention contemplates that W may be any desired value. As shown in FIG. 6B, assembly 20 is approaching an obstacle in its path, namely a road sign 150, so assembly 20 is gradually retracted onto boom 108 as it approaches sign 150 to thereby effectively decrease the width of excavated path 152 to W'. Finally, as shown in FIG. 6C, after assembly 20 has passed sign 150 and the width of excavation path 152 is gradually returned to width W by extending assembly 20 to its original position on boom 108.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. An earth excavating apparatus comprising:

a housing;

a rotatable drum partially disposed within said housing, said drum operable to loosen earthen material from the earth and direct the loosened earthen material into said housing;

a rotatable discharge fan attached to said housing, said discharge fan operable in a first position adjacent said drum to expel the loosened earthen material from said housing, and in a second position away from said drum to permit said drum to deposit the loosened earthen material onto the earth adjacent said drum;

means for rotating said drum; and means for rotating said discharge fan.

2. The earth excavating apparatus of claim 1 wherein said rotatable drum includes a plurality of earth pulverizing teeth thereon.

3. The earth excavating apparatus of claim 2 wherein said plurality of teeth are configured to direct the loosened earthen material inwardly toward a center of said drum.

4. The earth excavating apparatus of claim 3 wherein said discharge fan is pivotably attached to said housing, said discharge fan pivotable between said first and second positions.

5. The earth excavating apparatus of claim 4 further including means for pivoting said discharge fan between said first and second positions.

6. The earth excavating apparatus of claim 1 further including a fan housing attached to said housing and having said discharge fan mounted therein, said fan housing defining a discharge opening therethrough, said discharge fan expelling the loosened earthen material from said housing via said discharge opening.

7. The earth excavating apparatus of claim 5 wherein said fan housing is pivotably attached to said housing, said fan housing pivotable toward and away from said housing to position said discharge fan in said first and second positions respectively.

8. The earth excavating apparatus of claim 7 further including means for pivoting said fan housing toward and away from said housing.

9. The earth excavating apparatus of claim 1 wherein said rotatable drum is operable to rotate about a first axis and said discharge fan is operable to rotate about a second axis perpendicular to said first axis, said discharge fan expelling the loosened earthen material away from said housing in a direction parallel to said first axis.

10. The earth excavating apparatus of claim 9 wherein said second axis approximately bisects said rotatable drum;

and wherein said rotatable drum defines a plurality of teeth thereon arranged to direct the loosened earthen material inwardly toward a center of said drum.

11. An earth excavating apparatus comprising:

a housing having a front portion, a rear portion, a top portion and a bottom portion, said rear portion of said housing defining a first closable discharge opening adjacent said top portion and a second closable discharge opening adjacent said bottom portion;

a rotatable drum partially disposed within said front portion of said housing, said drum operable to loosen earthen material from the earth and direct the loosened earthen material toward said rear portion of said housing;

a rotatable discharge fan mounted within said rear portion of said housing, said discharge fan operable to direct the loosened earthen material away from said housing via one of said first and second closable openings;

means for rotating said drum; and means for rotating said discharge fan.

12. The earth excavating apparatus of claim 11 a wherein said housing has first and second opposing side portions extending between said front and rear portions, said rear portion of said housing defining said first closable opening through one of said first and second opposing side portions and said second closable opening through the other of said first and second opposing side portions.

13. The earth excavating apparatus of claim 4 further including means associated with said housing for maintaining a predefined operating angle of said rotatable drum with respect to horizontal.

14. The earth excavating apparatus of claim 11 further including a frame supporting said housing, said housing adjustably positionable relative to said frame between a substantially vertical transport position and an angle below horizontal to thereby vary an angle of earth pulverizing operation.

15. An earth excavating apparatus comprising:

a frame;

an elongated boom supported by said frame, said boom having a first end and an opposite second end;

an earth excavating assembly mounted to said boom, said excavating assembly including:

a housing;

a rotatable drum partially disposed within said housing, said drum operable to loosen earthen material from the earth;

means within said housing for directing the loosened earthen material away from said housing; and means for rotating said drum;

means for actuating said earth excavating assembly; and means for adjustably positioning said excavating assembly between a first position adjacent said first end of said boom and a second position adjacent said second end of said boom.

16. The earth excavating apparatus of claim 15 further including means associated with said excavating assembly for maintaining a predefined operating angle of said excavating assembly with respect to horizontal.

17. The earth excavating apparatus of claim 15 further including a collar attached at one end thereof to said boom and at an opposite end thereof to said excavating assembly;

wherein said means for adjustably positioning said excavating assembly between said first and second positions includes means for adjustably positioning said collar anywhere between said first and second ends of said boom.

18. The earth excavating apparatus of claim 15 further including:

means for adjusting a position of said first end of said boom relative to said frame; and means for adjusting a position of said second end of said boom relative to said frame.

19. The earth excavating apparatus of claim 15 wherein said excavating assembly is extendable along said boom away from said frame in the earth loosening operation thereof to correspondingly increase a surface area of said drum contacting the earth, and is retractable along said boom toward said frame in the earth loosening operation thereof to correspondingly decrease the surface area of said drum contacting the earth.

* * * * *